US007237622B2

(12) United States Patent
Liao

(10) Patent No.: US 7,237,622 B2
(45) Date of Patent: Jul. 3, 2007

(54) PNEUMATIC TOOL HAVING PRESSURE RELEASE DEVICE

(76) Inventor: Yu Hui Liao, No. 15, Lane 372, Sec. 1, Meicun Road, West Dist., Taichung 40358 (TW)

( * ) Notice: Subject to any disclaimer, the term of this patent is extended or adjusted under 35 U.S.C. 154(b) by 15 days.

(21) Appl. No.: 11/127,598

(22) Filed: May 11, 2005

(65) Prior Publication Data

US 2005/0254966 A1 Nov. 17, 2005

(30) Foreign Application Priority Data

May 13, 2004 (TW) ..... 93207478 U

(51) Int. Cl.
*B25D 16/00* (2006.01)
*B25D 17/00* (2006.01)
*B25D 17/10* (2006.01)

(52) U.S. Cl. ..... 173/104; 173/93.5; 173/93.6; 173/176

(58) Field of Classification Search ..... 173/93, 173/93.5, 93.6, 104, 176, 177; 415/15
See application file for complete search history.

(56) References Cited

U.S. PATENT DOCUMENTS

| | | | | |
|---|---|---|---|---|
| 3,827,834 | A | 8/1974 | Kakimoto | 418/15 |
| 5,217,079 | A * | 6/1993 | Kettner et al. | 173/177 |
| 6,110,045 | A * | 8/2000 | Schoeps | 464/25 |
| 6,179,063 | B1 * | 1/2001 | Borries et al. | 173/93.5 |
| 6,217,306 | B1 * | 4/2001 | Seward et al. | 418/270 |
| 6,334,494 | B1 * | 1/2002 | Nagato | 173/93.5 |

* cited by examiner

*Primary Examiner*—Rinaldi I. Rada
*Assistant Examiner*—Nathaniel Chukwurah
(74) *Attorney, Agent, or Firm*—Charles E. Baxley

(57) ABSTRACT

A pneumatic tool includes a rotor rotatably received in a housing, a driving shank coupled to the rotor, for being rotated by the rotor and by a pressurized air and having one end for driving a fastener. A pressure releasing device may release the pressurized air after the fastener has been tightly threaded onto the object to be fastened. A fluid container is rotatably received in the housing and coupled to the rotor, for partially receiving the driving shank. The driving shank has one or more paddles for being frictionally driven by the container and by the fluid. A pole is slidably engaged through the rotor, and actuated to release the pressurized air when the fastener has been tightly threaded onto the object.

6 Claims, 13 Drawing Sheets

PNEUMATIC TOOL HAVING PRESSURE RELEASE DEVICE

BACKGROUND OF THE INVENTION

1. Field of the Invention

The present invention relates to a pneumatic driving tool, and more particularly to a pneumatic driving tool having a pressure releasing device for suitably releasing the air or the air pressure within the pneumatic driving tool, and for preventing the pneumatic driving tool to continuously drive the fasteners even after the fasteners have been completely or tightly driven onto the objects to be fastened.

2. Description of the Prior Art

Typical pneumatic tool comprise a fan device or a rotor rotatably received within a housing and including a shank extended out of the housing, for engaging with and for driving fasteners or tool extensions or other tool members, and an air inlet for receiving and guiding a pressurized air toward the rotor device, in order to rotate or to drive the rotor device and thus to drive the fasteners or the tool extensions or other tool members.

For example, U.S. Pat. No. 3,827,834 to Kakimoto discloses one of the typical pneumatic tools comprising a van type rotor rotatably received within a motor cylinder, and including a drive shaft extended out of the motor cylinder, for engaging with and for driving fasteners or tool extensions or other tool members. A pressurized air is supplied into the motor cylinder and guided toward the rotor, in order to rotate or to drive the rotor and thus to drive the fasteners by such as the tool extensions or other tool members.

However, when or after the fasteners have been completely or tightly driven onto the objects to be fastened, or after a predetermined driving torque has been applied onto or against the fasteners or the tool extensions or other tool member, the pressurized air may still be or may continuously be supplied into the motor cylinder and may further rotate or to drive the rotor and the fasteners or the tool extensions or other tool member, such that the rotor and the fasteners or the tool extensions or other tool member may be damaged by the typical pneumatic tools.

The present invention has arisen to mitigate and/or obviate the afore-described disadvantages of the conventional pneumatic tool devices.

SUMMARY OF THE INVENTION

The primary objective of the present invention is to provide a pneumatic tool including a pressure releasing device for suitably releasing the air or the air pressure within the pneumatic driving tool, and for preventing the pneumatic driving tool to continuously drive the fasteners even after the fasteners have been completely or tightly driven onto objects.

In accordance with one aspect of the invention, there is provided a pneumatic tool comprising a housing including a chamber formed therein, a rotor rotatably received in the chamber of the housing, a driving shank coupled to the rotor, for being rotated by the rotor, and including one end for driving a fastener, the housing includes a conduit formed therein, for receiving and for guiding a pressurized air to drive the rotor to rotate relative to the housing, and a pressure releasing device may further be provided for releasing the pressurized air after the fastener has been tightly threaded onto an object to be fastened.

The housing includes a container rotatably received therein and coupled to the rotor, for being rotated in concert with the rotor, the container includes a chamber formed therein for receiving a fluid therein, and for partially receiving the driving shank.

The driving shank includes at least one paddle attached thereto for being frictionally driven by the container by the fluid, and includes at least one spring member disposed therein and engaged between the driving shank and the paddle, to bias the paddle against an inner peripheral surface of the container.

The pressure releasing means includes a pole slidably engaged through the rotor, the container includes a slot formed in an outer peripheral portion thereof and at least one orifice formed therein and communicating with the chamber and the slot thereof, for allowing the fluid to flow from the chamber into the slot via the orifice of the container, and to selectively force the pole to move relative to the housing and the rotor.

The housing includes a bore and a valve seat provided therein, and a spring-biased ball disposed in the bore of the housing and biased to selectively engage with and to block the valve seat of the housing, the pole is engaged with the ball, to selectively disengage the ball away from the valve seat of the housing when the fastener has been tightly threaded onto the object.

The housing includes a block disposed therein and having the bore and the valve seat provided in the block. The block includes a pathway formed therein, the housing includes a piston slidably disposed therein, and arranged to selectively block the pathway of the block.

The piston includes a longitudinal orifice and a transverse aperture formed therein, for selectively receiving the pressurized air flown into the housing, and the housing includes a release perforation formed therein, for selectively aligning with the transverse aperture of the piston when the piston blocks the pathway of the block.

The housing includes a first peripheral channel and a second peripheral channel formed therein and communicating with the chamber thereof, and a receptacle secured in the chamber of the housing for rotatably receiving the rotor therein, and the receptacle includes a first aperture and a second aperture formed therein and communicating with the first and the second peripheral channels of the housing respectively, and arranged to guide the pressurized air to drive the rotor to rotate in different direction relative to the housing, the first peripheral channel of the housing is communicating with the pathway of the block.

The container includes a rod slidably received in the slot thereof, and arranged to selectively block the orifice of the container, to adjust a flowing of the fluid through the orifice of the container, and thus to adjust a force of the fluid applied against the pole.

The container includes a duct formed therein for partially receive the pole, the rod includes a peripheral recess formed therein, and includes a transverse aperture and a longitudinal orifice formed therein for communicating the chamber and the orifice of the container with the duct of the container, and to allow the fluid to force and to move the pole relative to the rotor and the housing.

The rod includes a screw hole formed in one end thereof, and threaded with an adjusting screw, to move and to adjust the rod relative to the container when the adjusting screw is rotated relative to the container. The housing includes an orifice formed therein, for selectively communicating with the slot of the container, and thus for rotating the adjusting screw rotated relative to the container to adjust the driving torque of the driving shank against the fastener.

The container includes an inner peripheral surface, the rotor includes a plurality of blades slidably received therein, for engaging with the inner peripheral surface of the container when the rotor is rotated relative to the container. The rotor includes a plurality of cavities formed in an outer peripheral portion thereof and facing radially and outwardly therefrom, for slidably receiving the blades therein respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
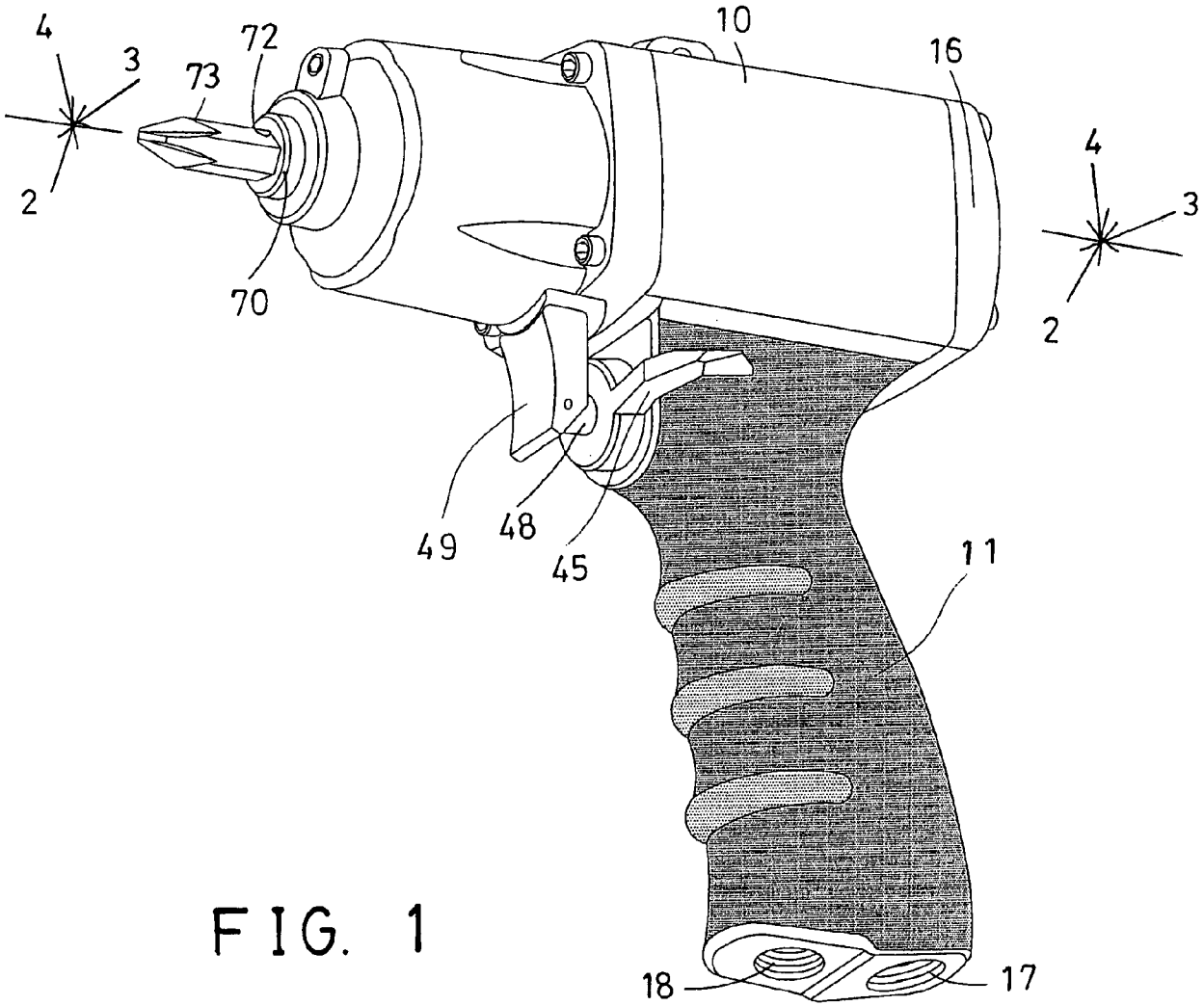
FIG. 1 is a perspective view of a pneumatic tool having a pressure release device in accordance with the present invention.
Figure 2:
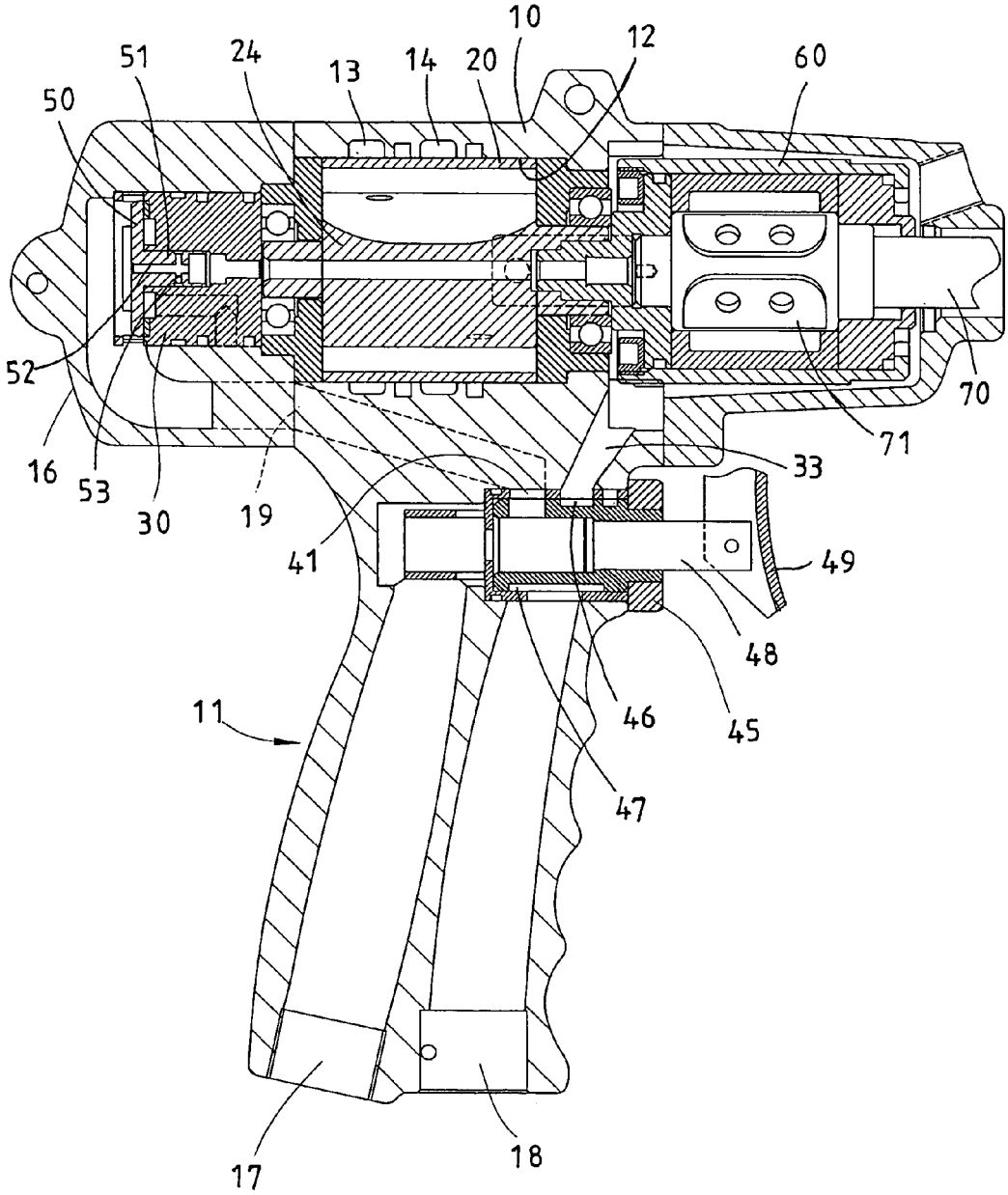
FIG. 2 is a partial cross sectional view taken along lines 2—2 of FIG. 1.
Figures 3, 9:
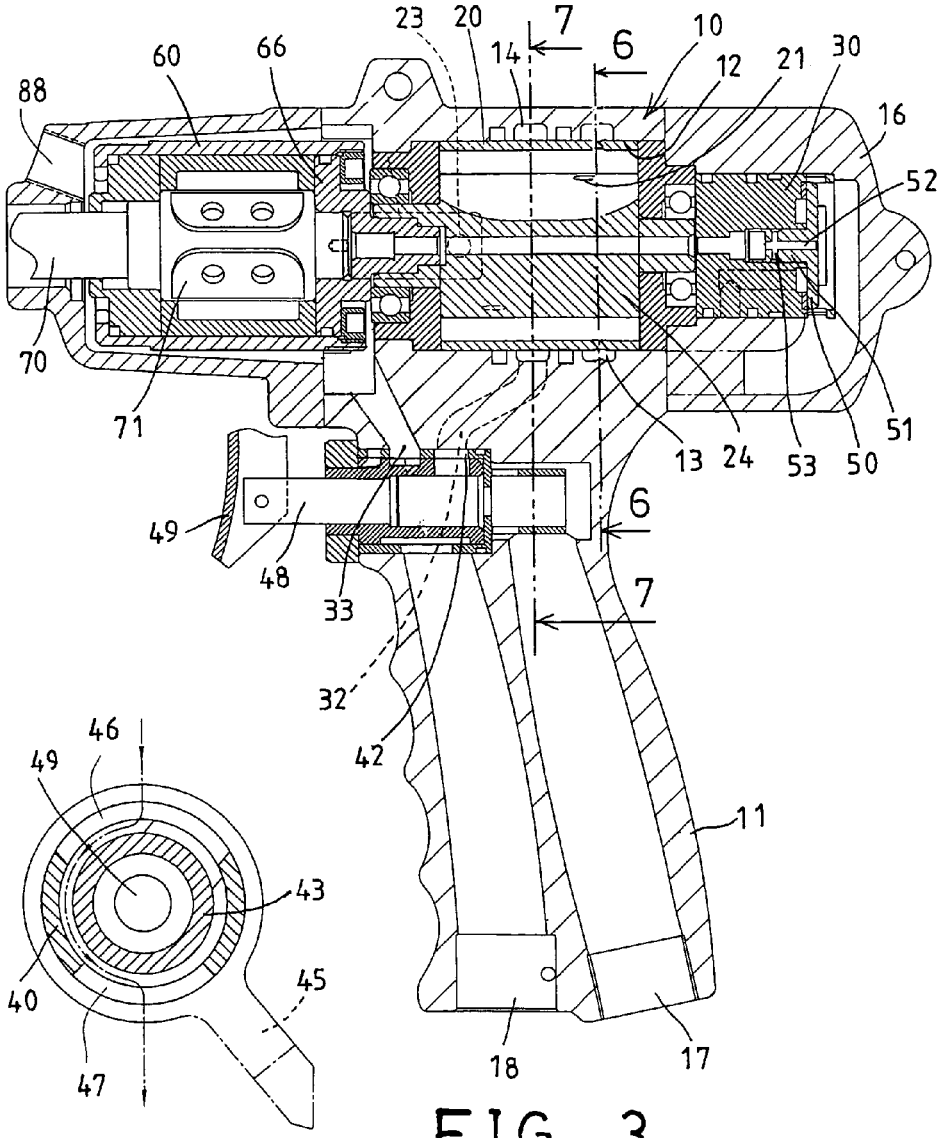
FIG. 3 is a partial cross sectional view taken along lines 3—3 of FIG. 1.
FIGS. 9, 10 are partial cross sectional views taken along lines 9—9 and 10—10 of FIG. 8 respectively.

Referring to the drawings, and initially to FIGS. 1–7, a pneumatic tool in accordance with the present invention comprises a body member or a housing 10 including a handle 11 extended downwardly therefrom, for being grasped or held by the users, and including a chamber 12 formed therein, and one or more, such as two peripheral channels 13, 14 and a passage 15 formed therein and communicating with the chamber 12 thereof, for air flowing purposes.

The handle 11 includes a cap 16 attached to the rear portion thereof, for enclosing the chamber 12 thereof, and includes an inlet 17 formed therein, for coupling to such as a pressurized air reservoir, for receiving the pressurized air therefrom, and includes an outlet 18 formed therein, for releasing the pressurized air. The housing 10 includes a conduit 19 formed therein (FIG. 2) for selectively communicating with the inlet 17 of the handle 11, to allow the pressurized air to flow into the housing 10, such as to flow into the cap 16 or the rear portion of the housing 10.

Figure 6:
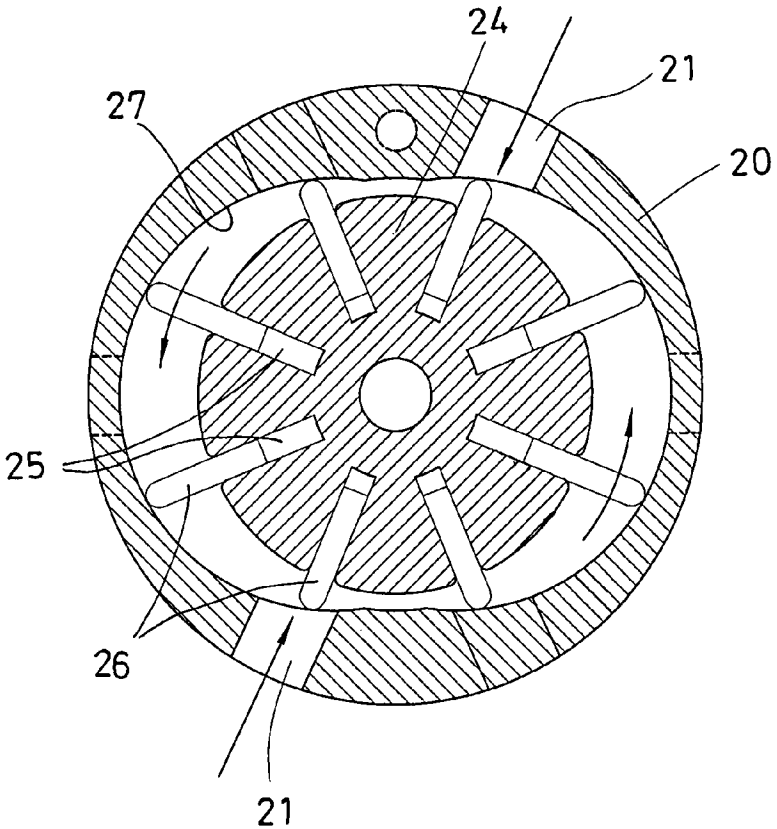
FIGS. 6, 7 are partial cross sectional views taken along lines 6—6 and 7—7 of FIG. 3 respectively.
Figure 7:
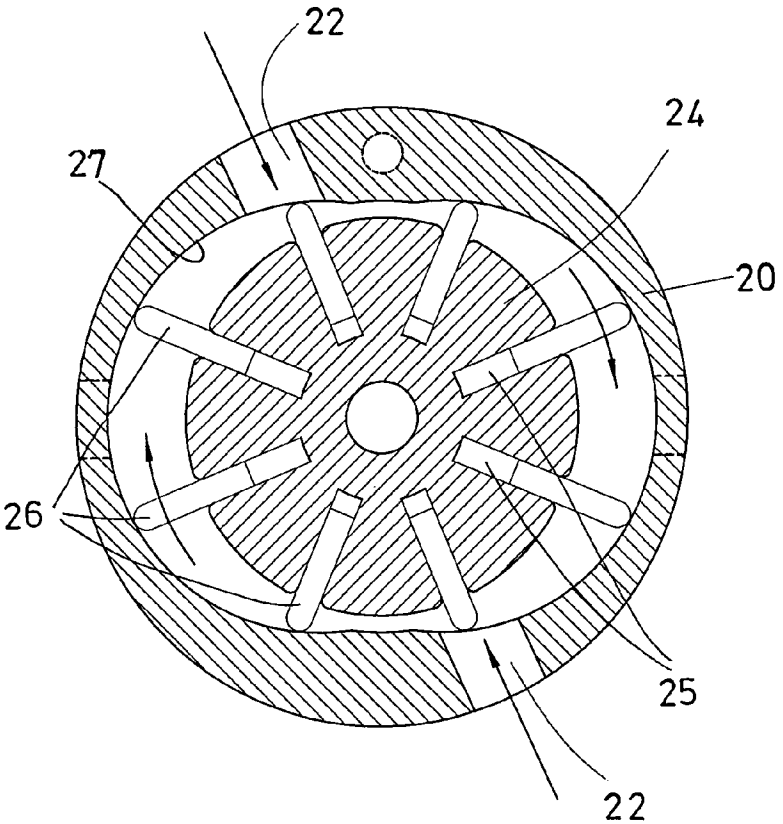
Figure 8:
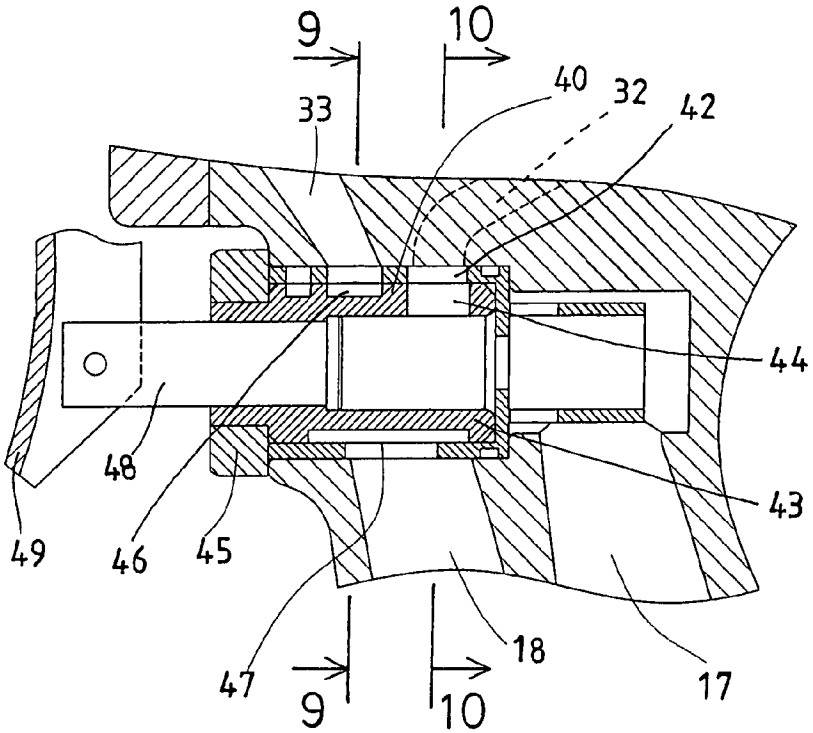
FIG. 8 is an enlarged partial cross sectional view of the pneumatic tool.

A receptacle 20 is received or secured within the chamber 12 of the housing 10 and includes one or more apertures 21, 22, 23 formed therein and communicating with the peripheral channels 13, 14 and the passage 15 of the housing 10 respectively, and includes a rotor 24 rotatably received therein. As best shown in FIGS. 6 and 7, the rotor 24 includes a number of cavities 25 formed in the outer peripheral portion thereof and facing radially and outwardly therefrom, for slidably receiving a number of fan blades 26 therein respectively.

The blades 26 may be forced to slide radially and outwardly relative to the rotor 24, to engage with an inner peripheral surface 27 of the receptacle 20, by an eccentric force, when the rotor 24 is rotated relative to the receptacle 20. As shown in FIG. 6, the apertures 21 of the receptacle 20 are arranged to guide the pressurized air into the receptacle 20, in order to rotate or to drive the rotor 24 to rotate in an active direction, for example. As shown in FIG. 7, the other apertures 22 of the receptacle 20 may be arranged to guide the pressurized air into the receptacle 20, in order to rotate or to drive the rotor 24 to rotate in a reverse direction, for example.

The cap 16 or the housing 10 includes an insert or a block 30 disposed or secured therein, and includes a pathway 31 formed therein (FIGS. 4–5 and 13–15), such as formed in the block 30 and/or the cap 16 and/or the housing 10, and communicating with the peripheral channel 13 of the housing 10, for guiding the pressurized air to flow into the apertures 21 of the receptacle 20 (FIGS. 5, 6), and thus to rotate or to drive the blades 26 and the rotor 24 in the active direction, for example.

The housing 10 includes a passageway 32 formed therein (FIGS. 3, 8, 16), and communicating with the other peripheral channel 14 of the housing 10, for guiding the pressurized air to flow into the other apertures 22 of the receptacle 20 (FIGS. 7, 13), and thus to rotate or to drive the blades 26 and the rotor 24. in the reverse direction, for example. As shown in FIGS. 2–3, 8, 12 and 16, a sleeve 40 is disposed or secured in the handle 11 and includes two holes 41, 42 formed therein for communicating with the conduit 19 and the passageway 32 of the housing 10 respectively.

Figure 10:
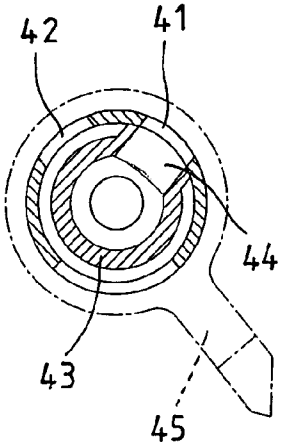
Figure 11:
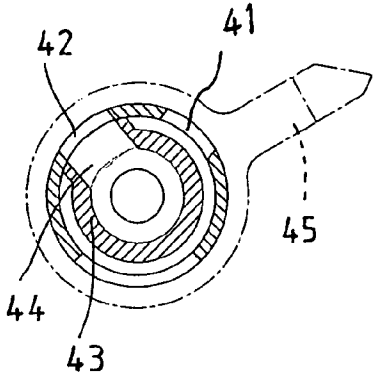
FIG. 11 is a partial cross sectional view similar to FIG. 10, illustrating the operation of the pneumatic tool.
Figure 12:
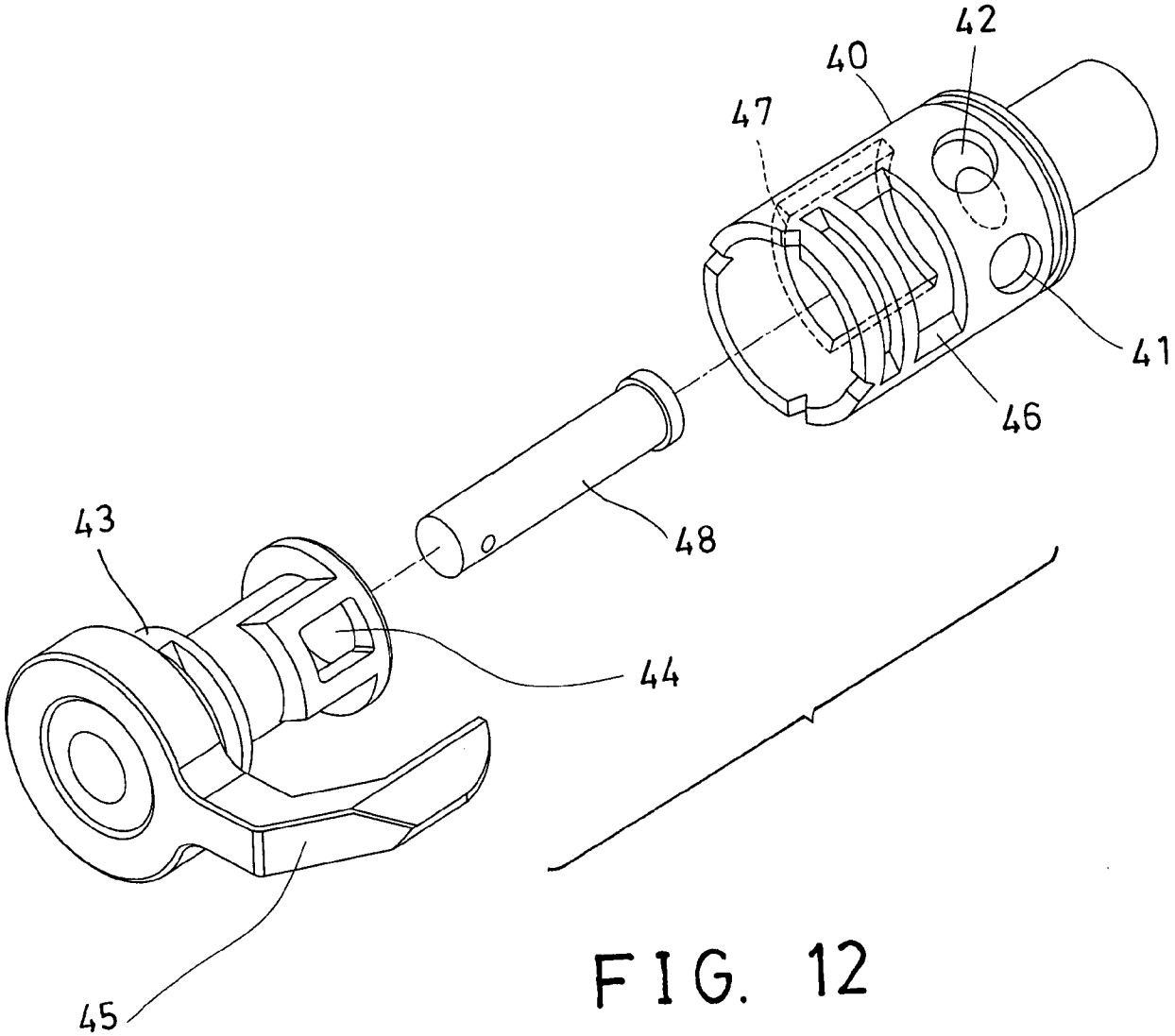
FIG. 12 is a partial exploded view illustrating the control device as shown in FIGS. 8–11, for the pneumatic tool.

A valve member 43 is rotatably disposed within the sleeve 40, and includes an opening 44 formed therein for selectively communicating with the holes 41, 42 of the sleeve 40 and thus the conduit 19 and passageway 32 of the housing 10 respectively (FIGS. 10–12), in order to selectively guide the pressurized air to flow into either the apertures 21 or the apertures 22 of the receptacle 20 (FIGS. 5, 6; and 7, 13), and thus to control the rotational directions of the blades 26 and the rotor 24.

The valve member 43 further includes two openings 46, 47 formed therein (FIGS. 9, 12) and communicating with the outlet 18 of the handle 11 and an exit 33 of the housing 10 respectively (FIGS. 2, 3, 8 and 12), and a valve stem 48 is slidably received or engaged in the valve member 43, and a trigger 49 is pivotally attached to the housing 10, and pivotally coupled to the valve stem 48, in order to move the valve stem 48 relative to the valve member 43 and the sleeve 40, and thus to selectively block the exit 33 of the housing 10, and/or to control the supplying of the pressurized air into the housing 10 and the receptacle 20 of the rotor 24. The valve stem 48 and the valve member 43 and the sleeve 40 are not related to the present invention and will not be described in further details.

Figure 4:
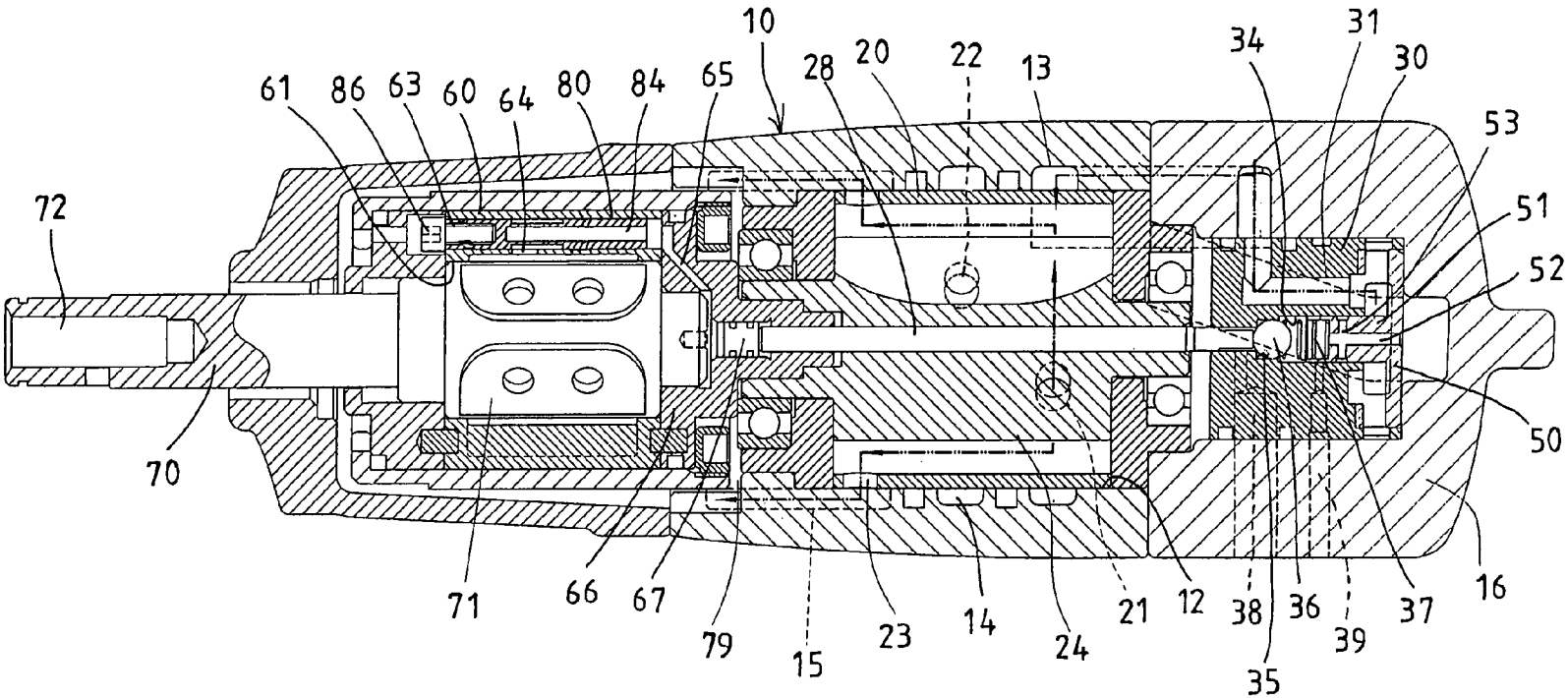
FIG. 4 is a partial cross sectional view taken along lines 4—4 of FIG. 1.
Figure 13:
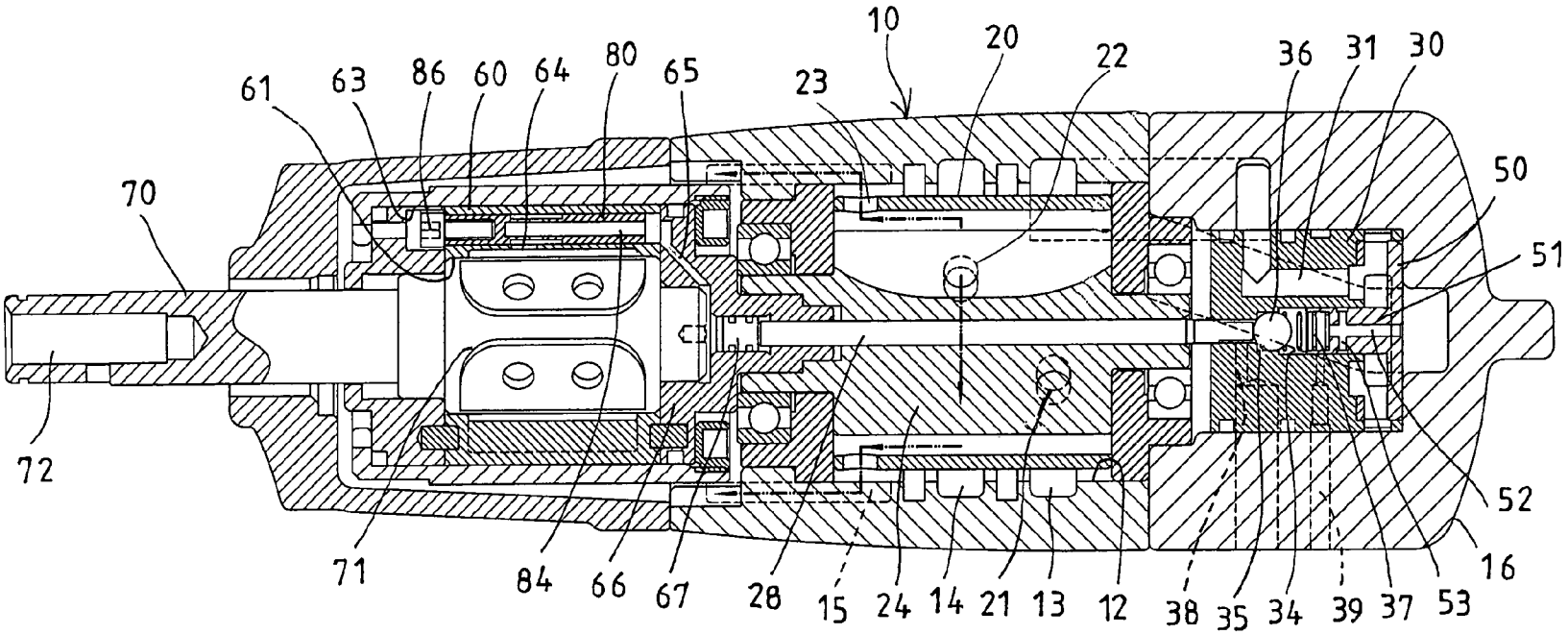
FIGS. 13, 14, 15 are enlarged partial cross sectional views similar to FIG. 5, illustrating the operation of the pneumatic tool.

As shown in FIGS. 4–5 and 13–15, the block 30 or the cap 16 or the housing 10 includes a bore 34 and a valve seat 35 formed or provided therein, and a ball 36 disposed in the bore 34 of the block 30 or the cap 16 or the housing 10, and biased by a spring member 37 to engage with and to selectively block the valve seat 35 of the block 30 or the cap 16 or the housing 10, and thus to selectively block a release perforation 38 of the block 30 or the cap 16 or the housing 10 (FIGS. 4, 13). The perforation 38 of the block 30 or the cap 16 or the housing 10 may be opened when the ball 36 is moved away from the valve seat 35 of the block 30 or the cap 16 or the housing 10, against the spring member 37 (FIGS. 5, 14–15), by such as a pole 28 which will be discussed hereinafter.

Figure 5:
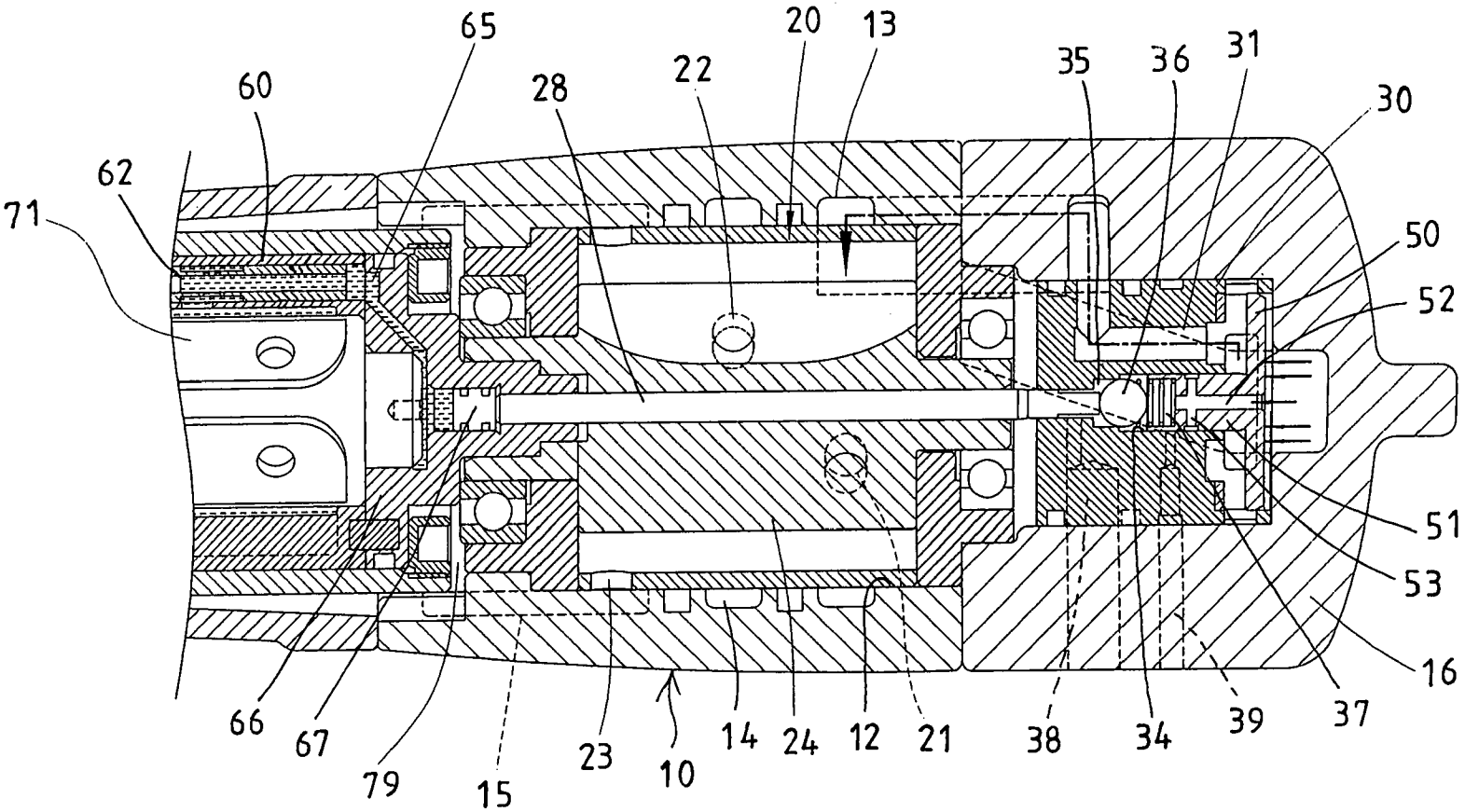
FIG. 5 is an enlarged partial cross sectional view of the pneumatic tool as shown in FIG. 4.
Figure 14:
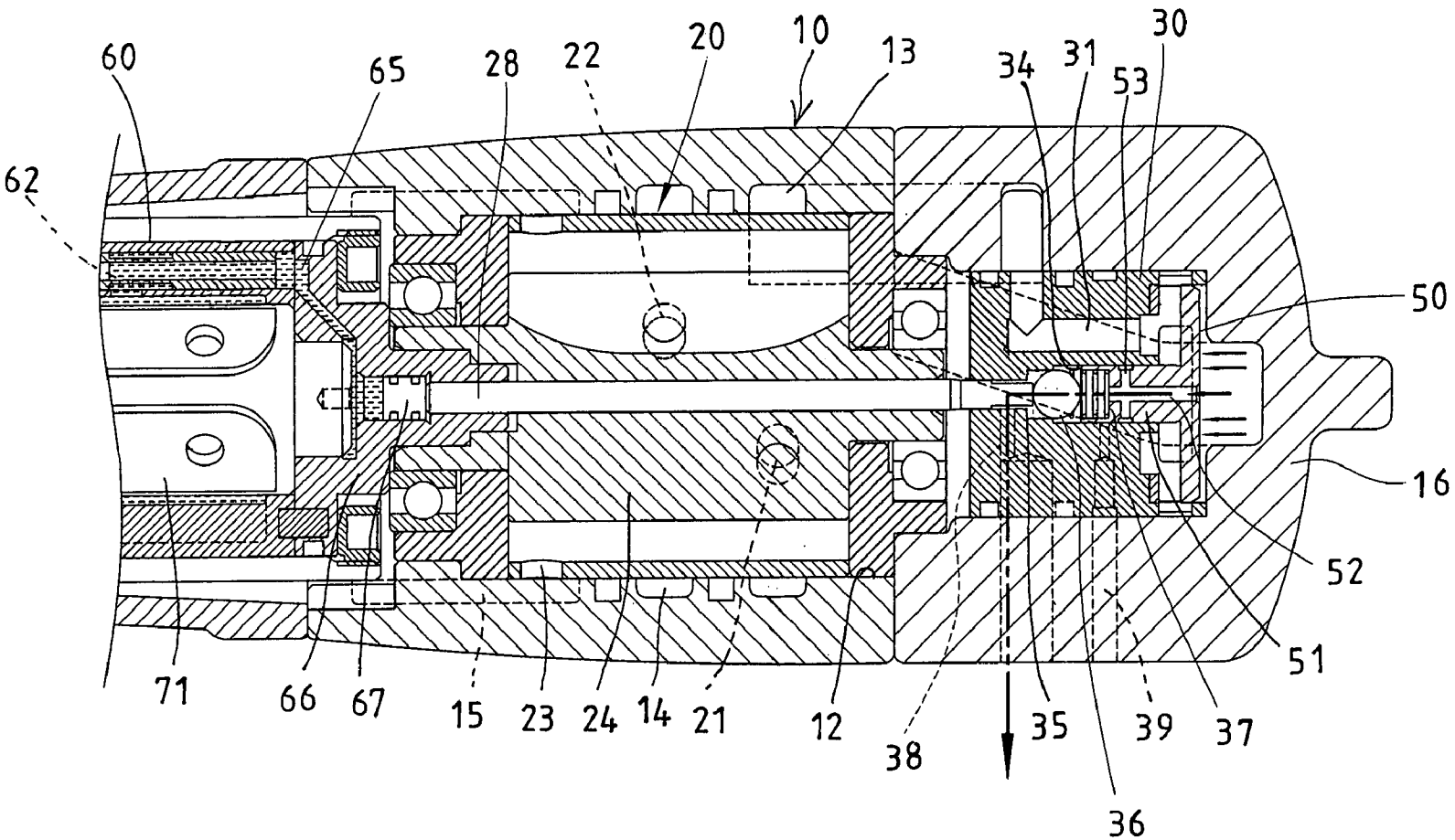

A piston 50 is slidably disposed in the housing 10, such as slidably disposed between the block 30 and the cap 16 of the housing 10, and includes an extension 51 extended therefrom and slidably engaged into the bore 34 of the block 30, for engaging with the spring member 37, and includes a longitudinal orifice 52 and a transverse aperture 53 formed therein and intersecting or perpendicular to each other, for selectively receiving the pressurized air that flows into the conduit 19 of the cap 16 or of the housing 10 (FIGS. 5, 14).

In operation, as shown in FIGS. 4, 5, the piston 50 or the extension 51 of the piston 50 is normally biased away from the block 30 by the spring member 37, and thus to open the pathway 31 of the block 30 or of the housing 10, and thus to allow the pressurized air to flow into the apertures 21 of the receptacle 20 and thus to rotate or to drive the blades 26 and the rotor 24 in the active direction.

As shown in FIGS. 5 and 14, when the ball 36 is moved away from the valve seat 35 of the block 30 or the housing 10, the pressurized air may flow through the longitudinal orifice 52 of the piston 50 and then to flow out through the release perforation 38 of the block 30 or the housing 10. At this moment, the pressure in the chamber 12 of the housing 10 and in the pathway 31 of the block 30 or of the housing 10 may be greatly decreased, and the pressurized air flowing into the conduit 19 of the housing 10 may thus force the piston 50 to block the pathway 31 of the block 30 or of the housing 10, until the transverse aperture 53 of the piston 50 is aligned with another release perforation 39 of the block 30 or the housing 10 (FIG. 15), through which the pressurized air may further be released.

As shown in FIGS. 2–5 and 13–18, a container 60 is rotatably received in the front portion of the chamber 12 of the housing 10 and includes a chamber 61 formed therein for receiving a fluid, such as a hydraulic oil or fluid 62 therein (FIGS. 5, 14–15), and a slot 63 formed in the outer peripheral portion thereof and one or more orifices 64 formed therein and communicating with or between the chamber 61 and the slot 63 thereof, for allowing the hydraulic oil or fluid 62 to selectively flow from the chamber 61 into the slot 63 via the orifices 64 of the container 60.

As shown in FIGS. 4–5 and 13–15, the slot 63 of the container 60 is coupled to a duct 65 of the container 60, or a casing 66 may be secured between the container 60 and the rotor 24 and may have the duct 65 formed therein. The container 60 and the casing 66 and the rotor 24 will be rotated in concert with each other, relative to the housing 10 and the block 30. The pole 28 is slidably engaged in the housing 10 or through the rotor 24, and includes a piston or an enlarged head 67 secured thereto, and slidably engaged in the duct 65 of the container 60 or of the casing 66, for allowing the hydraulic oil or fluid 62 to force or to move the pole 28 relative to the rotor 24 and the housing 10 and the block 30.

A driving shank 70 includes one end 71 rotatably received in the chamber 61 of the container 60, and an engaging hole 72 formed in the other end thereof for receiving a tool bit 73 or other tool members 73 (FIG. 1), and for rotating or driving the tool bit 73 or tool members 73. The driving shank 70 further includes one or more, such as two channels 74 formed therein (FIGS. 17, 18) for slidably receiving one or more paddles 75 therein, and one or more cavities 76 formed therein and communicating with each channel 74 for receiving spring members 77 which may be engaged between the driving shank 70 and the paddles 75 and which may bias the rounded or curved outer ends 78 of the paddles 75 to engage with an inner peripheral surface 68 of the container 60.

Figure 18:
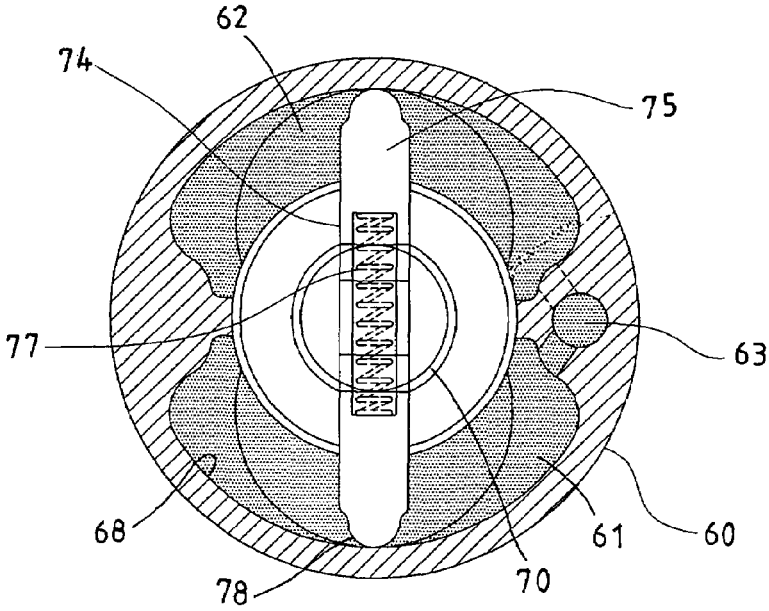
FIG. 18 is a partial cross sectional view taken along lines 18—18 of FIG. 16.

In operation, as shown in FIG. 18, the paddles 75 are rotatably received in the hydraulic oil or fluid 62 that is received within the chamber 61 of the container 60. In addition, the hydraulic oil or fluid 62 is sealingly received and confined within the chamber 61 of the container 60 and the duct 65 of the container 60 or the casing 66, such that the paddles 75 and thus the driving shank 70 may be rotated by or in concert with the container 60 frictionally by the hydraulic oil or fluid 62, when the container 60 and the casing 66 and the rotor 24 are rotated or driven relative to the housing 10 and the block 30 by the pressurized air.

Figure 15:
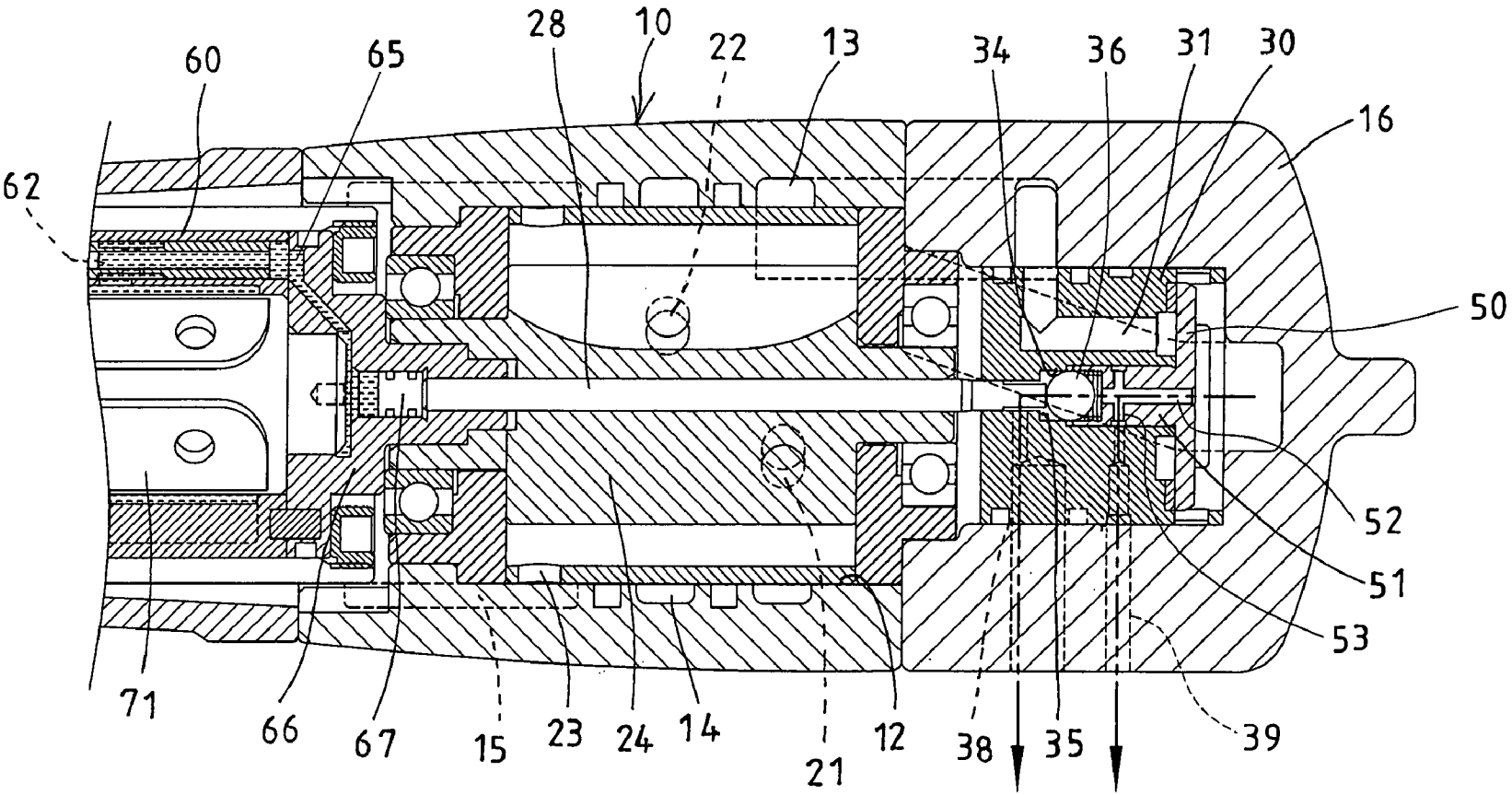

When the fasteners to be driven have been completely or tightly driven onto the objects to be fastened, or after the driving shank 70 and the tool member 73 has applied a predetermined driving torque against the fasteners to be driven, or when the fasteners may no longer be rotated or driven by the driving shank 70 and the tool member 73, or when the driving shank 70 and the tool member 73 are stopped by the fasteners, the hydraulic oil or fluid 62 contained within the chamber 61 of the container 60 may be forced by the paddles 75 to flow into the slot 63 via the orifices 64 of the container 60, and then to flow into the duct 65 of the container 60, in order to actuate the pole 28 (FIGS. 5 and 14–15).

As described before, the ball 36 may then be moved away from the valve seat 35 of the block 30 or the cap 16 or the housing 10, against the spring member 37 by the pole 28, to allow the pressurized air to flow through the longitudinal orifice 52 of the piston 50 and then to flow out through the release perforation 38 of the block 30 or the housing 10, in order to release the pressure within the chamber 12 of the housing 10 and the pathway 31 of the block 30 or of the housing 10. The pressurized air flowing into the conduit 19 of the housing 10 may then force the piston 50 to block the pathway 31 of the block 30 or of the housing 10, until the transverse aperture 53 of the piston 50 is aligned with the other release perforation 39 of the block 30 or the housing 10 (FIG. 15), through which the pressurized air may further be released.

When the pressurized air flows out through either or both of the release perforations 38, 39 of the block 30 or the housing 10, the users or the operators may thus know that the fasteners to be driven have been completely or tightly driven onto the objects to be fastened, and may thus actuate the trigger 49 to stop or to turn off the pressurized air, and to prevent the pressurized air from being continuously supplied to the housing 10.

When the valve member 43 is rotated relative to the sleeve 40, to align the opening 44 thereof with the hole 42 of the sleeve 40 and thus the passageway 32 of the housing 10 (FIG. 3), the pressurized air may be guided to flow into the apertures 22 of the receptacle 20, and thus to rotate the blades 26 and the rotor 24 in the reverse direction, and thus for unthreading the fasteners. The pressurized air may then flow into an outlet passage 79 of the housing 10 (FIGS. 4, 5) and/or the passage 15 of the housing 10 via the apertures 23 of the receptacle 20, and then to flow out through the outlet 33 of the housing 10 and the outlet 18 of the handle 11. When the fasteners are unthreaded by the driving shank 70, there is no need to control the torque applied to the fasteners.

Figure 17:
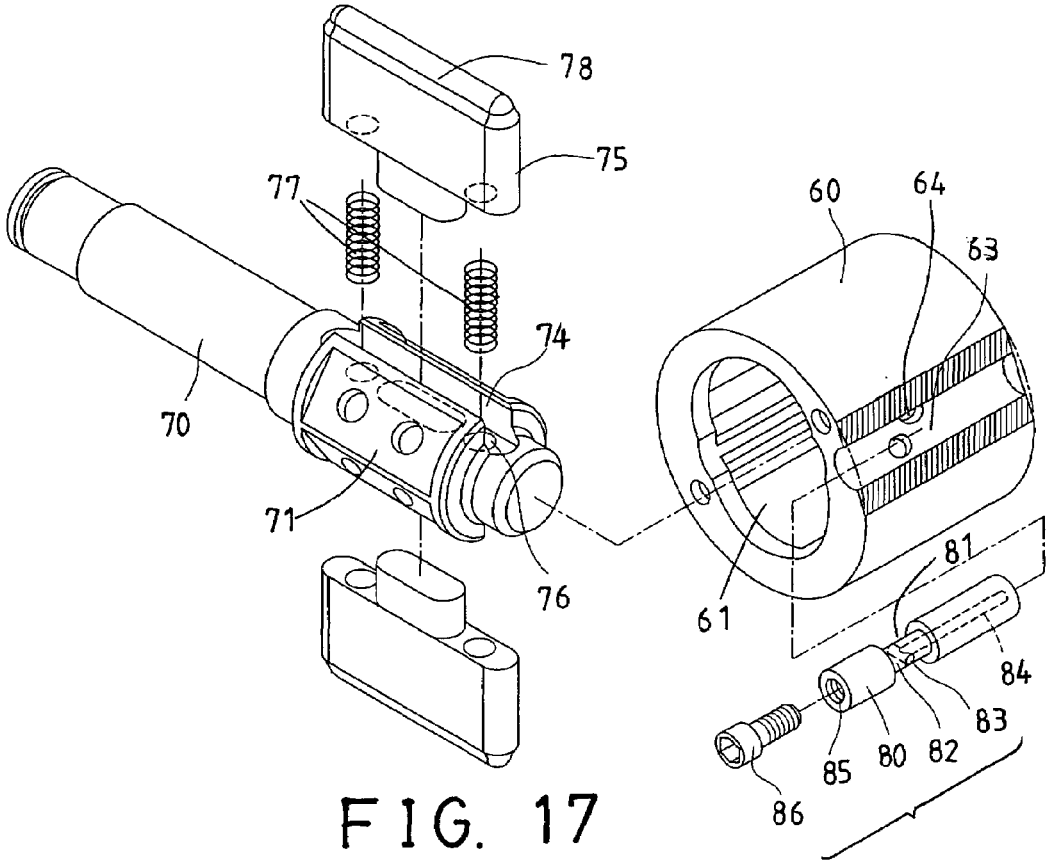
FIG. 17 is a partial exploded view illustrating the driving mechanism of the pneumatic tool.

As shown in FIGS. 4, 13 and 17, a rod 80 is slidably received in the slot 63 of the container 60, and includes a peripheral recess 81 formed in a middle portion thereof, and includes a transverse aperture 83 and a longitudinal orifice 84 formed therein and intersecting or perpendicular to each other, for communicating the chamber 61 and the orifices 64 of the container 60 with the duct 65 of the container 60 or of the casing 66, and thus to allow the hydraulic fluid 62 to force or to move the pole 28 relative to the rotor 24 and the housing 10 and the block 30.

The rod 80 further includes a screw hole 85 formed in one end thereof for threading with an adjusting screw 86 which may be rotatably received or retained within the container 60, to prevent the adjusting screw 86 from sliding relative to the container 60. When the adjusting screw 86 is rotated relative to the container 60 and the rod 80, the rod 80 may be moved relative to the container 60, to adjustably blocking the orifices 64 of the container 60, and thus to adjust the force of the hydraulic fluid 62 applied against the pole 28, in order to adjust the driving torque applied onto or against the fasteners or the tool extensions or other tool member by the driving shank 70.

Figure 16:
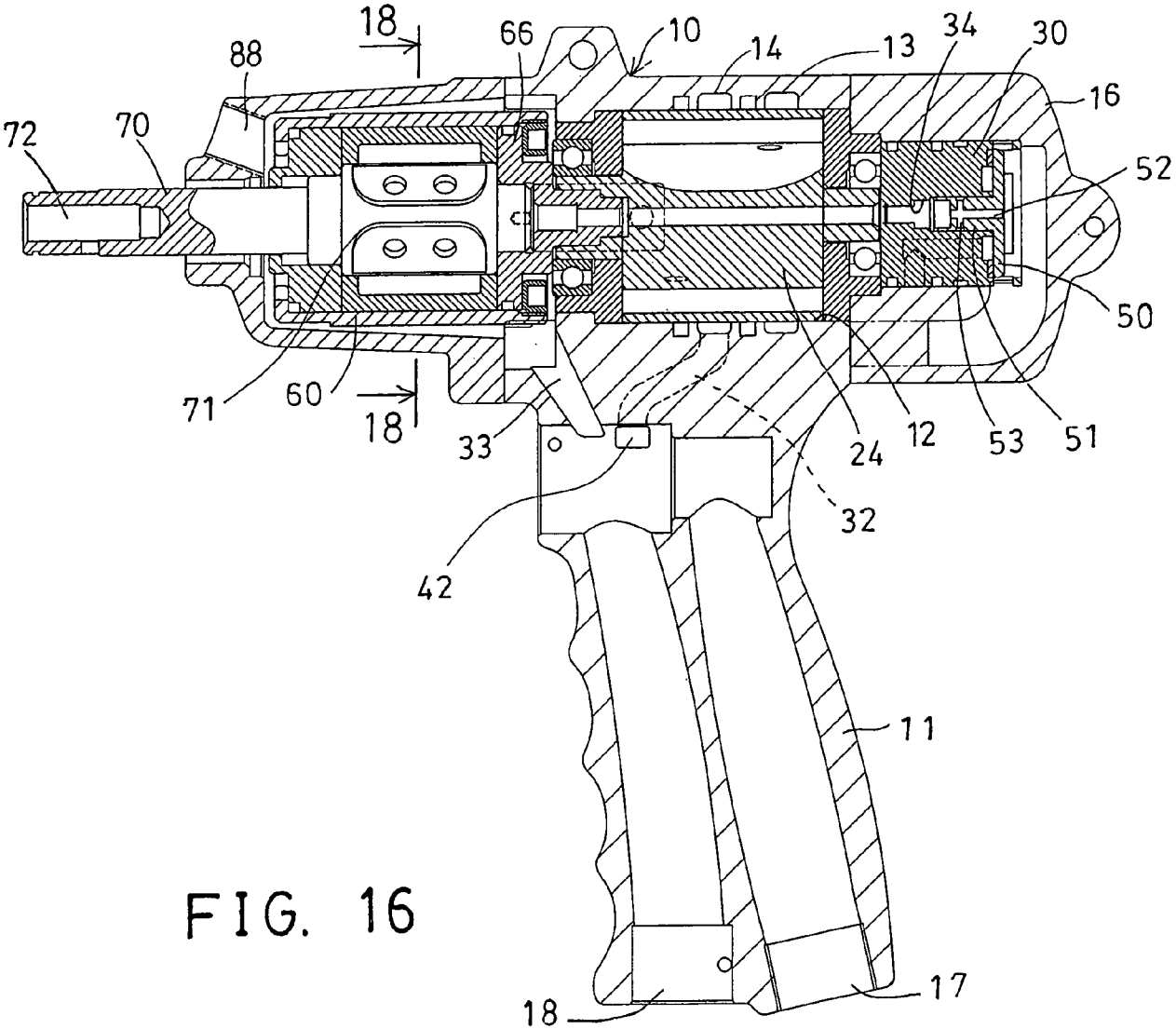
FIG. 16 is a partial cross sectional view similar to FIG. 3, illustrating the arrangement of the pneumatic tool.

As shown in FIGS. 44 and 16, the housing 10 may include an orifice 88 formed therein, for selectively communicating with the slot 63 of the container 60, and for allowing the other driving tools to engage into the housing 10 and to rotate the adjusting screw 86 relative to the container 60 and the rod 80, in order to adjust the driving torque applied onto or against the fasteners or the tool extensions or other tool member by the driving shank 70. The pole 28 and the ball 36 may thus be formed as a pressure releasing means or device for suitably releasing the air pressure and for preventing the fasteners from being continuously driven or rotated by the driving shank 70 even after the fasteners have been completely or tightly driven onto the objects. The conventional pneumatic tools have no pressure releasing device to release the air pressure and to stop the driving shank 70.

Accordingly, the pneumatic tool in accordance with the present invention includes a pressure releasing device for suitably releasing the air or the air pressure within the pneumatic driving tool, and for preventing the pneumatic driving tool to continuously drive the fasteners even after the fasteners have been completely or tightly driven onto objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pneumatic tool comprising:

a housing including a chamber formed therein, a rotor rotatably received in said chamber of said housing, a driving shank coupled to said rotor, for being rotated by said rotor, and including one end for driving a fastener, a container rotatably received in said housing and coupled to said rotor for being rotated in concert with said rotor, said container including a chamber formed therein for receiving a fluid therein and for partially receiving said driving shank, said container including a slot formed in an outer peripheral portion thereof and at least one orifice formed therein and communicating with said chamber and said slot thereof, for allowing the fluid to flow from said chamber into said slot via said at least one orifice of said container, said driving shank including at least one paddle attached thereto for being frictionally driven by said container by the fluid, and including at least one spring member disposed therein and engaged between said driving shank and said at least one paddle, to bias said at least one paddle against an inner peripheral surface of said container, a block disposed in said housing and including a bore and a valve seat provided therein, said block including a pathway formed therein, a spring-biased ball disposed in said bore of said block and biased to selectively engage with and to block said valve seat of said block, a piston slidably disposed in said housing and arranged to selectively block said pathway of said block, said housing including a conduit formed therein, for receiving and for guiding a pressurized air to drive said rotor to rotate relative to said housing, and a pressure releasing means for releasing the pressurized air after the fastener has been tightly threaded onto an object to be fastened, said pressure releasing means including a pole slidably engaged through said rotor, the fluid flowing from said chamber into said slot via said at least one orifice of said container selectively forcing said pole to move relative to said housing and said rotor, said pole being engaged with said ball to selectively disengage said ball away from said valve seat of said block when the fastener has been tightly threaded onto the object, said piston including a longitudinal orifice and a transverse aperture formed therein, for selectively receiving the pressurized air flown into said housing, and said housing including a release perforation formed therein for selectively aligning with said transverse aperture of said piston when said piston blocks said pathway of said block, a rod slidably received in said slot of said container and arranged to selectively block said at least one orifice of said container, to adjust a flowing of the fluid through said at least one orifice of said container, and to adjust a force of the fluid applied against said pole, and said container including a duct formed therein for partially receiving said pole, said rod including a peripheral recess formed therein and including a transverse aperture and a longitudinal orifice formed therein for communicating said chamber and said at least one orifice of said container with said duct of said container, and to allow the fluid to force and to move said pole relative to said rotor and said housing.

2. The pneumatic tool as claimed in claim 1, wherein said housing includes a first peripheral channel and a second peripheral channel formed therein and communicating with said chamber thereof, and a receptacle secured in said chamber of said housing for rotatably receiving said rotor therein, and said receptacle includes a first aperture and a second aperture formed therein and communicating with said first and said second peripheral channels of said housing respectively, and arranged to guide the pressurized air to drive said rotor to rotate in different direction relative to said housing, said first peripheral channel of said housing is communicating with said pathway of said block.

3. The pneumatic tool as claimed in claim 1, wherein said rod includes a screw hole formed in one end thereof, and threaded with an adjusting screw, to move and to adjust said rod relative to said container when said adjusting screw is rotated relative to said container.

4. The pneumatic tool as claimed in claim 3, wherein said housing includes an orifice formed therein, for selectively communicating with said slot of said container, and for rotating said adjusting screw rotated relative to said container.

5. The pneumatic tool as claimed in claim 1, wherein said container includes an inner peripheral surface, said rotor includes a plurality of blades slidably received therein, for engaging with said inner peripheral surface of said container when said rotor is rotated relative to said container.

6. The pneumatic tool as claimed in claim 5, wherein said rotor includes a plurality of cavities formed in an outer peripheral portion thereof and facing radially and outwardly therefrom, for slidably receiving said blades therein respectively.

* * * * *